United States Patent [19]

Reigstad et al.

[11] Patent Number: 4,928,451

[45] Date of Patent: May 29, 1990

[54] ANCHOR APPARATUS FOR A TENDON IN PRESTRESSED CONCRETE SLAB

[75] Inventors: Gordon H. Reigstad, North St. Paul; A. Norris Breivik, Forest Lake; Hanley S. Reigstad, Sunburg, all of Minn.

[73] Assignee: Tech Research, Inc., St. Paul, Minn.

[21] Appl. No.: 273,197

[22] Filed: Nov. 18, 1988

Related U.S. Application Data

[60] Division of Ser. No. 916,151, Oct. 7, 1986, Pat. No. 4,743,354, which is a continuation-in-part of Ser. No. 870,654, May 30, 1986, abandoned, which is a continuation-in-part of Ser. No. 785,333, Oct. 7, 1985, abandoned.

[51] Int. Cl.[5] ..... E04C 5/08

[52] U.S. Cl. ..... 52/223 L; 52/230

[58] Field of Search ..... 52/223 L, 230, 223 R, 52/225, 224; 14/22

[56] References Cited

U.S. PATENT DOCUMENTS

| | | | |
|---|---|---|---|
| 3,399,434 | 9/1968 | Kelly | 52/230 |
| 3,524,228 | 8/1970 | Kelly | 52/230 |
| 3,703,748 | 11/1972 | Kelly | 52/223 L |
| 3,762,027 | 10/1973 | Burtelson | 52/223 L |
| 3,833,706 | 9/1974 | Edwards | 52/230 |
| 3,843,288 | 10/1974 | Howlett et al. | 52/223 L |
| 3,956,797 | 5/1976 | Brandestini et al. | 52/230 |
| 4,363,462 | 12/1982 | Wlodkowski et al. | 52/223 L |
| 4,561,226 | 12/1985 | Tourneur | 52/223 L |
| 4,773,198 | 9/1988 | Reinhardt | 52/223 L |

*Primary Examiner*—Michael Safavi

*Attorney, Agent, or Firm*—Merchant, Gould, Smith, Edell, Welter & Schmidt

[57] ABSTRACT

An anchor apparatus which provides corrosion protection for the exposed cable in a region around where the anchor body attaches to a tendon of a prestressed concrete slab is disclosed. A conduit is fastened to the inlet end of the anchor body. The other end of the conduit is taped or connected with heat shrink tubing to the covering on the tendon. The outlet end of the anchor body is closed either with a plug at an end anchor or with a second conduit and tape or heat shrink tubing at an intermediate anchor. Fittings are provided for inserting corrosion resistant grease into interior cavities as a second line of corrosion protection.

2 Claims, 5 Drawing Sheets

FIG. 1
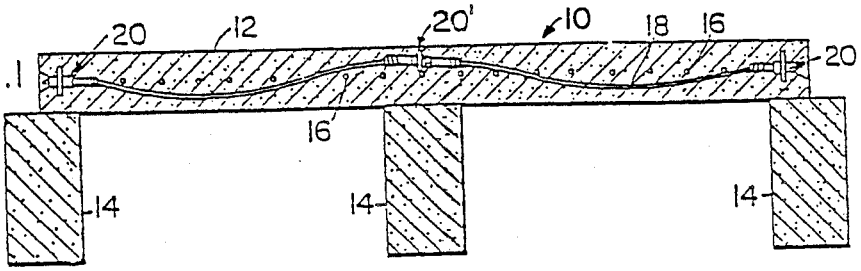
FIG. 2B
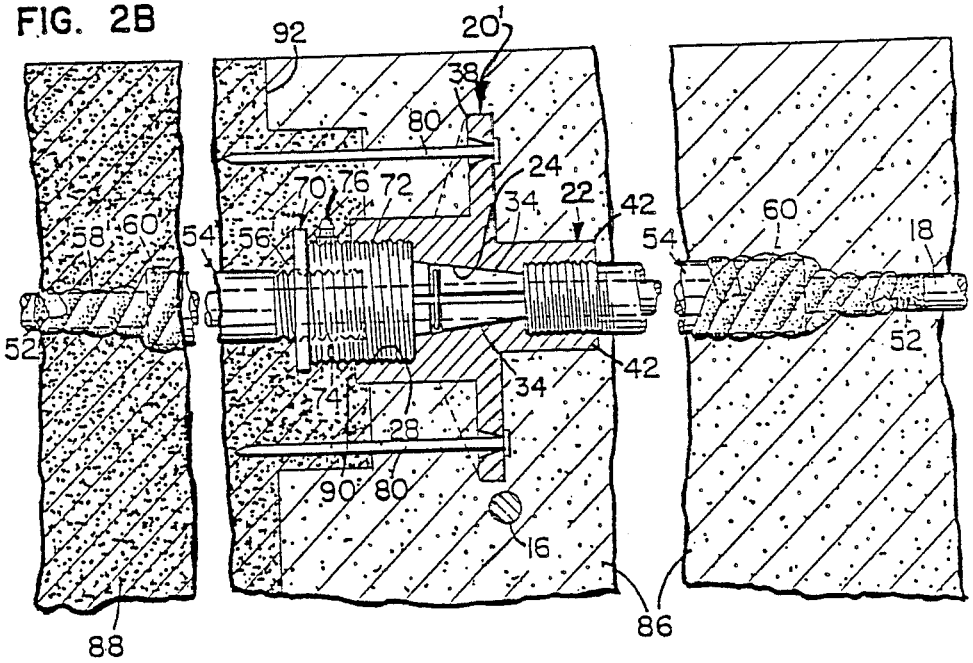
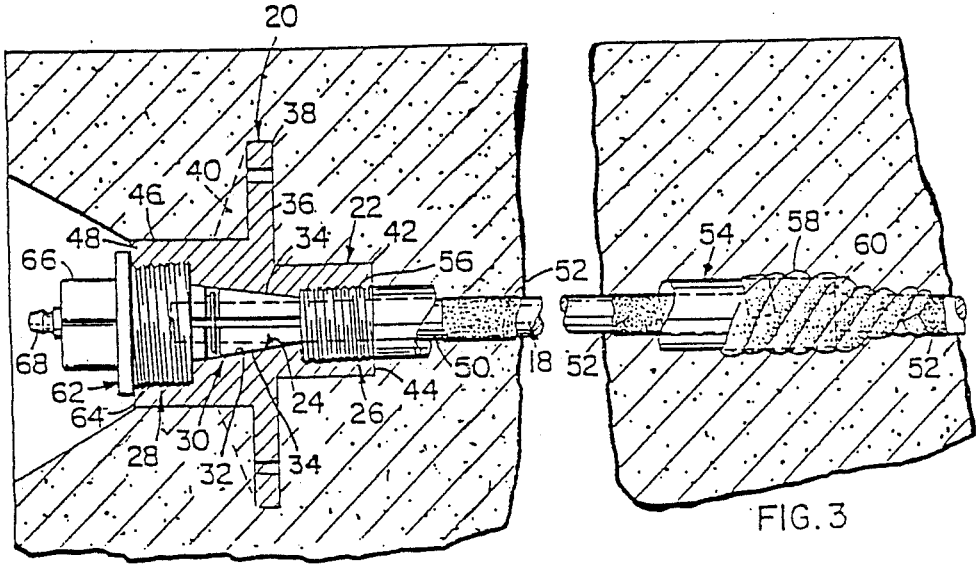
FIG. 3

ANCHOR APPARATUS FOR A TENDON IN PRESTRESSED CONCRETE SLAB

This is a division of application Ser. No. 916,151 filed Oct. 7, 1986, now U.S. Pat. No. 4,743,354, which is a continuation-in-part of Ser. No. 870,654, filed May 30, 1986 now abandoned, which is a continuation of Ser. No. 785,333, filed Oct. 7, 1985, now abandoned.

FIELD OF THE INVENTION

The present invention is directed to anchor devices for a tendon in a concrete slab and, more particularly, to such a device including mechanism for resisting corrosion in a region around where the anchor device attaches to the tendon.

BACKGROUND OF THE INVENTION

Anchor devices for holding tendons in a stressed condition in a prestressed concrete slab are known. In U.S. Pat. No. 3,596,330, a preexisting coating or covering for a wire tendon is sealed to one end of an anchor by a deformable washer which is pressed into a sealing configuration by wedges holding the stressed tendon to the anchor. A plug or cap closes the other end of the anchor. The problem with this device is that it is very difficult to make a precise stripping of the cover on a tendon so that it ends, for example, at the washer. Hence, it is likely difficult to achieve the purpose of the device. In U.S. Pat. No. 3,956,797, shield elements are shown which fit over one end of the anchor body and extend out over a portion of the tendon. In U.S. Pat. No. 4,053,974, a shield member is formed to extend from paper wrapper about the tendon to a tube which is installed during pouring of the concrete around the anchor and a form holding the anchor body. After the concrete hardens, the tube is removed. The shield member remains in place, but its intent is simply to prevent concrete from entering the tube and contacting the exposed cable of the tendon since after the tube is removed, the shield member does not extend to the anchor member. Over the years, this mechanism will not prevent corrosive fluids from seeping through the concrete and contacting the exposed cable. In U.S. Pat. No. 4,363,462, the space between a shield member and the anchor body is filled with a grease or some other corrosion protection substance.

Known devices do not consider the needs of large prestressed slabs wherein both end anchors and intermediate anchors are required and wherein corrosion protection should be provided for the exposed cable of a tendon in the regions of each of the several anchors. In this regard, known anchors do not show mechanism for providing fast, efficient and positive sealing connections at selectively one or both ends of an anchor.

SUMMARY OF THE INVENTION

The present invention is directed to an anchor device for holding a tendon in a stressed condition in a prestressed concrete slab wherein the tendon has a corrosion resistant covering, but wherein the covering is incomplete in a region around where the anchor device is attached to the tendon. The device includes wedges and an anchor body for receiving the wedges. The anchor body has a central passage for receiving the tendon. The passage has a longitudinal centerline. The passage further has an inlet section, an outlet section and a central section therebetween. The central section includes a conical portion for receiving and providing a seat for the wedges. The inlet section has a smaller transverse dimension through the longitudinal centerline than the outlet section. The anchor body further includes a mechanism for resisting longitudinal movement with respect to the cement slab. The anchor device further includes a first conduit having first and second end portions. In addition, the anchor device includes a mechanism for sealingly attaching the first end portion of the first conduit to the inlet section of the anchor body. Also, the anchor device includes first means for sealing the second end portion of the first conduit to the covering on the tendon to enclose one end of the region wherein the corrosion resistant covering is incomplete. The anchor device still further includes a mechanism for sealingly closing the outlet section of the anchor body with respect to the other end of the region of the tendon wherein the corrosion resistant covering is incomplete.

In end anchors, the closing mechanism includes a plug. In intermediate anchors, the closing mechanism includes a reducer which decreases the diameter of the outlet section for attachment to a second conduit by connecting with the reducer just like the first conduit which is connected to the other end of the anchor body. The unattached ends of both conduits are taped, enclosed with a heat shrink tube or otherwise sealed to the covering on the tendon. Thus, the present anchor apparatus advantageously may be used for both end and intermediate anchor applications.

Of further advantage is that a grease fitting may be installed in the closure plug for an end anchor and in the reducer for an intermediate anchor for the purpose of forcing grease into the conduits and the central passage of the anchor body. Thus, the present apparatus not only provides for enclosing the region around where the anchor grips the tendon, but also provides for filling the enclosed space with a corrosion resistant grease.

In another embodiment, a heat shrink tube provides sealing between the inlet section of the anchor body and the covering on the tendon. In situations where this embodiment may be used, the conduit of the previously discussed embodiment is not necessary. With respect to the outlet section of the anchor body, a plug is used to sealingly close it when the anchor is used as an end anchor. For an intermediate anchor, a reducer is used to reduce the transverse cross section of the outlet section so that a second heat shrink tube may be used to provide a seal between the reducer and the covering on the tendon.

These advantages and other objects obtained by the invention are further explained hereinafter and may be better understood by reference to the more detailed description which refers to the drawings briefly described as follows.

BRIEF DESCRIPTION OF THE DRAWINGS

FIG. 1 is a cross-sectional view of a concrete slab showing in side view a tendon held by an intermediate anchor and end anchors in accordance with the present invention;

FIG. 2B is a partial cross-sectional view of an installed intermediate anchor;

FIG. 3 is a partial cross-sectional view of an end anchor;

Similarly.

DETAILED DESCRIPTION OF THE PREFERRED EMBODIMENT

Figure 2A:
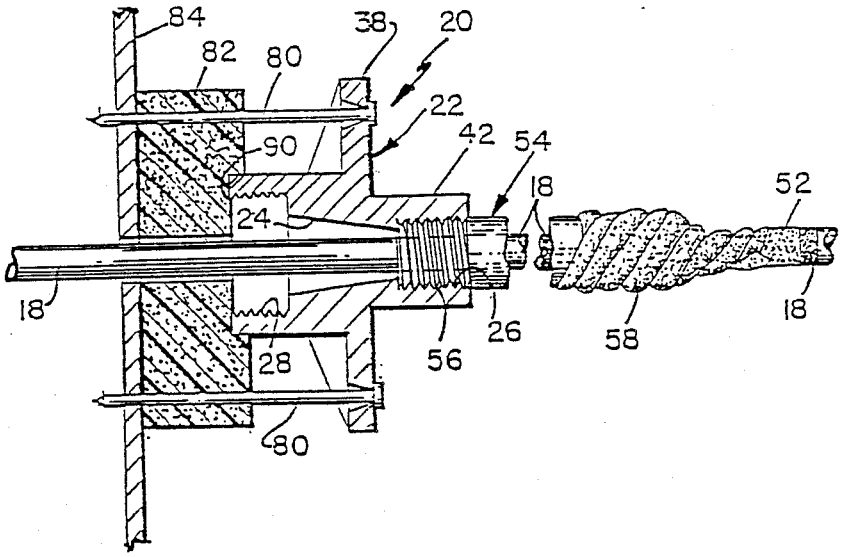
FIG. 2A is a partial cross-sectional view of an intermediate anchor as held by a formboard prior to having cement cast with respect to it.

Referring now to the drawings wherein like reference numerals designate identical or corresponding parts throughout the several views, and more particularly to FIG. 1, an apparatus for holding a tendon 18 in a stressed condition in a prestressed concrete slab 12 is designated generally by the numeral 10. Slab 12 is shown supported by a plurality of beams 14. A plurality of temperature tendons 16 extend transversely through slab 12 with respect to the longitudinal extension of primary tendon 18. A pair of anchor devices 20 hold tendon 18 at its opposite ends. An intermediate anchor device 20′ holds tendon 18 at a location between its opposite ends, preferably at a midpoint between adjacent anchors and for a one way slab system preferably near a beam 14. It is understood that the present invention applies also to a two way slab system. It is further understood that the present apparatus is applicable for any tendon anchorage, whether draped or not.

As shown in FIG. 3, device 20 includes anchor body 22 having a central passage 24 therethrough. Passage 24 is aligned along a longitudinal centerline (not shown for clarity reasons). Passage 24 includes an inlet section 26, an outlet section 28 and a central section 30 in the region between the inlet and outlet sections 26 and 28. The central section has a conical portion 32 for receiving and providing a seat for a set of wedges 34. Inlet section 26 is internally threaded with a diameter preferably at least as large as the smallest diameter of conical portion 32 to which it mates. Outlet section 28 is also internally threaded. Outlet section 28 has a larger transverse dimension when measured through the longitudinal centerline of passage 24 than inlet section 26. With respect to conical portion 32, the diameter of outlet section 28 is larger so that wedges 34 may be readily inserted through outlet section 28 into central section 24 around tendon 18.

Anchor body 22 has an outwardly extending, transverse, flat surface 36 which is one side of an outwardly extending flange 38 supported on the side opposite surface 36 by a plurality of gussets 40. Surface 36 may be located anywhere along the longitudinal dimension of body 22. Surface 36 is shown approximately half way between the ends of body 22. Surface 36 butts against the concrete of slab 12 to prevent anchor body 22 from moving longitudinally with respect to slab 12 even though body 22 is holding tendon 18 in tension.

The portion 42 of body 22 toward inlet end 44 of body 22 has a smaller transverse dimension than portion 46 extending toward outlet end 48 from flange 38. Portion 46 must be sufficiently large to provide structure for the larger threaded portion of outlet section 28. Similarly, portion 42 must be sufficiently large to provide structure for the smaller threaded portion of inlet section 26.

Tendon 18 is commonly a cable wrapped with a treated paper or covered with a layer of a plastic material or some other corrosion resistant covering 52. Covering 52 is stripped away from the cable 50 in the region of device 20 so that wedges 34 can reliably grip cable 50 and not slip or press into any soft covering. As a result, the uncovered region of tendon 18 often extends beyond anchor body 22. In the past, such uncovered regions were subject to corrosive fluids seeping through the concrete of slab 12. Furthermore, since anchor 20 and 20′ are generally nearer the upper surface of slab 12 than the rest of tendon 18, any seepage by corrosive fluid often reached the uncovered regions before it reached the covered portion of tendon 18. In any case, the present invention is directed to solving the problem of protecting such uncovered regions from corrosive fluids.

A conduit 54 is threaded at a first end portion 56 to mate with the threaded portion of inlet section 26 of anchor body 22. Tape 58 or other sealing mechanism is fastened between the second end portion 60 of conduit 54 and covering 52 of tendon 18.

A closure plug 62 seals passage 24 at outlet end 48 of anchor body 22. Plug 62 includes a threaded end 64 for mating with the threaded portion of outlet section 28. The other end of plug 62 is preferably square or hexigonal so that it may be easily engaged with a common wrench. A fitting 68 is installed in the end of plug 62 so that a common grease gun may be used to force grease through fitting 68 into passage 24 of anchor body 22 and into conduit 54. Although the enclosed space bounded by passage 24 in anchor body 22, conduit 54, tape 58 and plug 62 adequately encloses the region of tendon 18 having an incomplete covering, nevertheless, a corrosion resistant grease advantageously provides a second mechanism for minimizing any tendon weakening due to corrosion. In addition, it is noted that the enclosed space encloses the volatile gases vaporizing from the grease and helps to keep the vapor pressure high and prevent the grease from breaking down.

It is further noted that it is desirable to use a sealant between the threads of plug 62 and the threads of section 28, as well as between the threads of conduit 54 and the threads of inlet section 26.

Device 20′ has the same anchor body 22 as device 20 Furthermore, device 20′ includes a set of wedges 34 and has a conduit 54 with tape 58 for sealing one end of the uncovered region of tendon 18 in the vicinity of device 20′. Rather than a plug 62, however, a reducer 70 fits into the outlet section 28 of anchor body 22 of device 20′. Reducer 70 has an outer threaded portion 72 extending to one end for mating with the threaded portion of outlet section 28. Reducer 70, in addition, has an inner threaded portion 74 extending to the other end for receiving the first threaded end portion 56′ of a second conduit 54′ which is exactly the same as first conduit 54. Anchor body 22 is, thus, advantageously designed so that outlet section 28 may be used with a reducer 70 to decrease the diameter of the threaded portion in order to receive a second conduit just like the first conduit thereby sealing both ends of body 22 in a similar fashion. In this regard, tape 60′ seals between second end portion 58′ of conduit 54 and covering 52 of tendon 18.

A fitting 76 is installed in reducer 70 to provide a mechanism for inserting corrosion resistant grease into the enclosed space generally formed within body 22, conduits 54 and 54′, and reducer 70.

In use, a tendon 18 may be installed during the initial construction of a cement slab 12 or under some circumstances, a new tendon 18 may replace a previously removed tendon in an existing cement slab. In any case, the end anchors 20 and intermediate anchors 20' must be located and fixed with respect to the slab 12 or the space to be occupied by the slab 12. Many times, no intermediate anchors are needed. On the other hand, there are many times when one or more intermediate anchors 20' are needed. In either case, the opposite end of tendon 18 with respect to the anchor which is being installed is fixed. Generally, such opposite end is fixed with an end anchor 20. Such opposite end anchor is positioned on a form known to those so skilled. Before or after fixing the end anchor in position, a first conduit 54 is threaded to it and tendon 18 is passed through the anchor body 22 and held by wedges 34.

With respect to installing the intermediate anchor 20' or the second end anchor 20, similarly, either before or after fixing the anchor body 22 at a predetermined location, the first threaded end portion of first conduit 54 is threaded into the first threaded portion of inlet section 26 of anchor body 22. In the case of an existing slab, the tendon 18 is passed through the various anchor bodies, reducers, and conduits while they are being located and fixed in place. In the case of new construction, a tendon 18 may be passed through the appropriate first conduit 54 and the central passage of the anchor body 22 of the anchor to be installed after the anchor has been positionally fixed. The second end portion of first conduit 54 is then sealed with tape 58 to covering 52 of tendon 18. To illustrate, in FIG. 2A, an intermediate anchor 20' is shown fixed in place relative to a form prior to casting concrete. Nails 80 are passed through openings in flange 38 and extend through a block 82, for example Styrofoam, to engage form 84, likely a wooden plank. Conduit 54 is attached at first end portion 56 to portion 42 of anchor body 22. The second end portion 60 of conduit 54 is sealed with tape 58 to covering 52 on tendon 18. Tendon 18 extends through conduit 54 and the central passage 24 of anchor body 22, as well as through block 82 and form 84.

Next, concrete 86 (see FIG. 2B) is cast in the space between the fixed end and the anchor to be installed. In the case of a tendon replaced in an existing slab, concrete is cast around the tendon to fill in the slab wherever portions were removed. Only the outward ends of the facing anchors are not covered with concrete in order to provide for subsequent tendon stressing. In the case of new construction, concrete is cast in the space in which the slab is to be created and between the forms holding the anchors. As shown in FIG. 2B, concrete 88 at this point in the process would not be present since it would be cast during a subsequent iteration of the process when anchor body 20' as shown in FIG. 2B functions as a fixed anchor at one end of a new portion of slab to be installed. It is clear that block 82 keeps central passage 24 and end 90 of anchor body 22 free of concrete 86 so that wedges 34 may be inserted into central section 24 at the appropriate time.

Before stressing, wedges 34 are placed in central section 32 of passage 24. Tendon 18 is then pulled in a known fashion with respect to the fixed end to place the tendon in a stressed condition, thereby pre-stressing the slab. Wedges 34, acting against the wall of the central passage of the anchor body, hold the tendon in the stressed condition. If the anchor installed in this way is an intermediate anchor 20', at a later time when a subsequent end anchor 20 is installed and the tendon is further stressed, the intermediate anchor 20' will be relieved so that wedges 34 provide little or no holding force with respect to anchor body 22.

Finally, the second end of the installed anchor is sealed. For an intermediate anchor 20', a second conduit 54' at first end portion 56' is threaded into portion 74 of reducer 70. Reducer 70 is threaded into the outlet section 28 of anchor body 22. The second end portion 60' of second conduit 54' is sealed with tape 58' to cover 52 of tendon 18 thereby completely enclosing any region around anchor body 22 in which covering 52 has been stripped away. End anchor 20 is installed in a similar fashion, except plug 62 is threaded into outlet section 28 instead of reducer 70 and second conduit 54' to form the seal for the outlet end.

As a further step in the use of devices 20 and 20', a corrosion resistant grease may be forced through fitting 76 in device 20' or fitting 68 in device 20 to fill the internally enclosed space thereby further protecting the uncovered region of tendon 18. After all anchors have been sealed, further cement, for example, concrete 88, may or may not be cast around the anchors to encapsulate them and create the desired facade for the slab. In any case, the sealing mechanisms protect the anchors from exposure and from water leakage, especially salt water leakage. If the anchors are not encapsulated, it is clear that the anchors would be exposed and vulnerable to deterioration mechanisms. This is especially significant where a construction joint 92 is formed.

Figure 4:
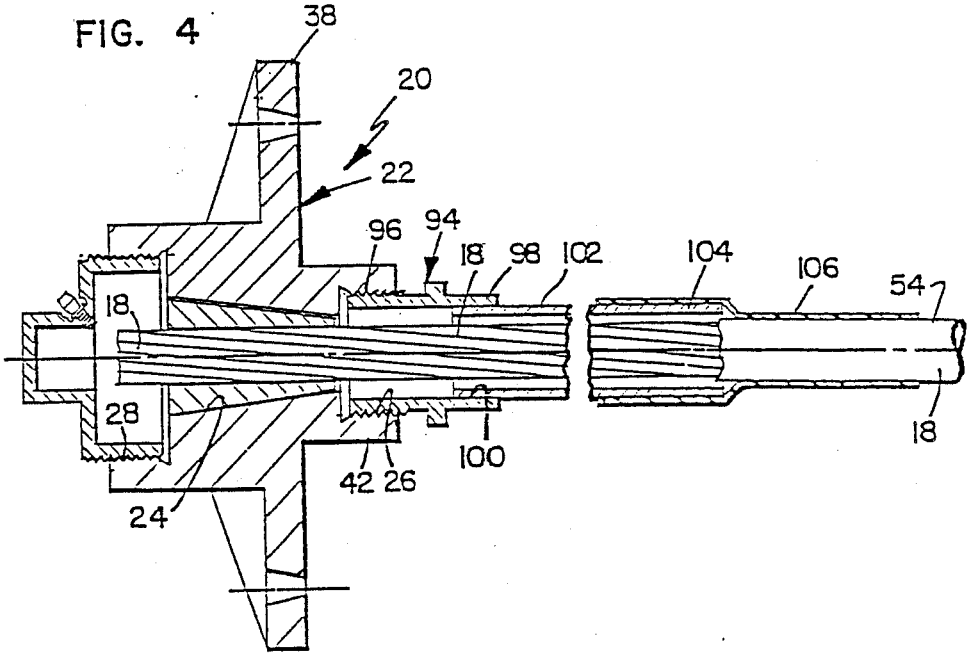
FIGS. 4–8 are diagrammatic cross-sectional views showing alternative embodiments for plugs closing the outlet section of an anchor device and for mechanisms to seal between the inlet section and the tendon covering.

A number of alternate embodiments for the present invention are also possible. As shown in FIG. 4, a first threaded end 96 of a connector 94 is threaded into mating threads, in a receiving cavity formed at inlet section 26 of anchor body 22. The second end 98 of connector 94 has a cylindrical interior passage 100 into which conduit 102 fits. Conduit 102 may form a friction fit with passageway 100 or it may be glued thereto with an adhesive. The second end portion 104 of conduit 102 is sealed with respect to covering 52 on tendon 18 with a heat shrink tube 106.

Several embodiments showing different connections for a conduit to the inlet section of an anchor body are shown in FIGS. 5–8. In addition, it is understood that these various embodiments could also be used with respect to the outlet section, usually in conjunction with a reducer, although not necessarily since the various connectors discussed hereinafter could also function as reducers simply by changing dimensions at the end whic connects with the anchor body.

Figure 5:
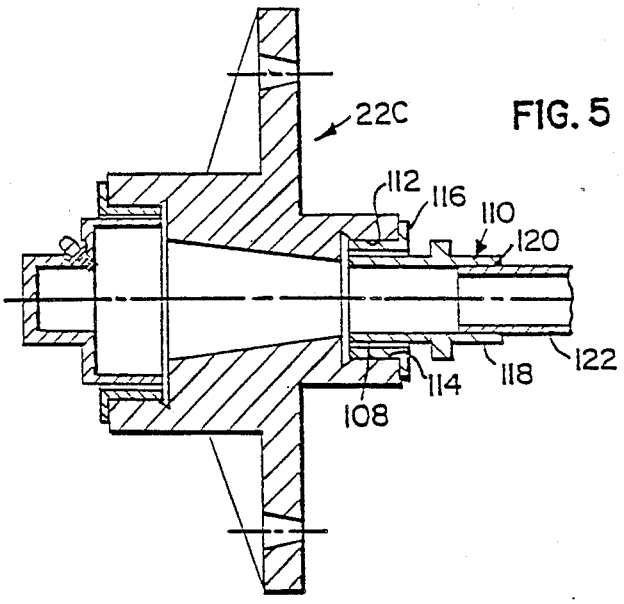

In FIG. 5, the first end 108 of connector 110 is inserted in the receiving cavity 112 of the inlet section 114 of anchor body 22. A gasket 116 is fitted between first end 108 of conduit 110 and the wall of cavity 112. Gasket 116 compresses to provide a seal and friction fit between first end 108 and the wall of cavity 112. If necessary, an adhesive may be used to insure the attachment of the parts. The second end 118 of connector 110 connects with first end portion 120 of conduit 122 by receiving first end portion 120 as a friction fit within the cylindrical passage at second end 118 of connector 110. Again, if desired, an adhesive may be used between the parts.

Figure 6:
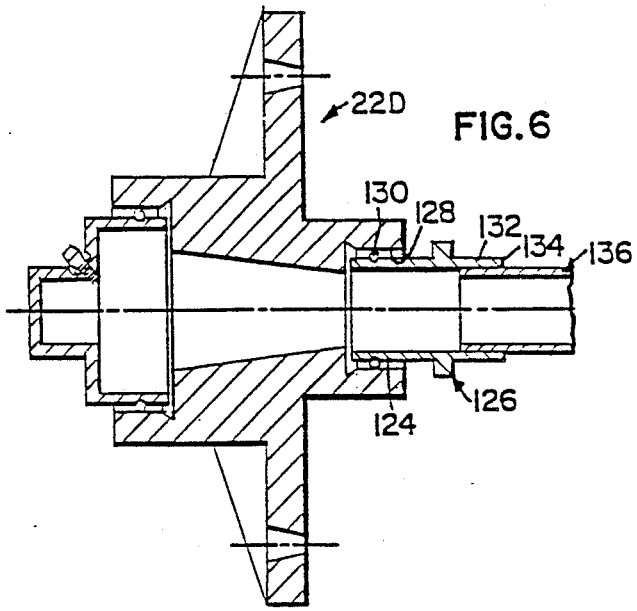

As shown in FIG. 6, a first end 124 of connector 126 is inserted in receiving cavity 128. An O-ring 130 installed between first end 124 and the wall of cavity 128 forms a seal and also provides for a friction fit between the parts. The second end 132 of connector 126 is sealingly connected with the first end portion 134 of conduit 136 in a fashion similar to the device of FIG. 5.

Figure 7:
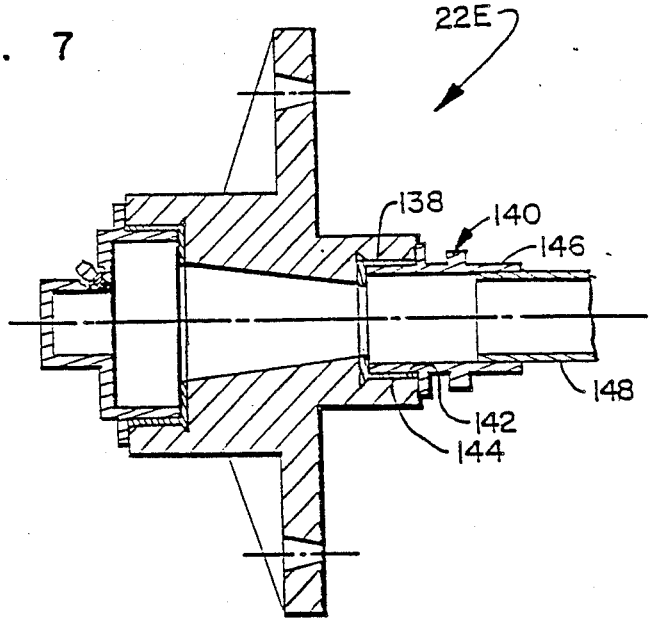

As shown in FIG. 7, the first end 138 of connector 140 is fitted into receiving cavity 142 and held in place by an adhesive layer 144. As with the other embodiments, the second end 146 of connector 140 is sealingly connected with conduit 148.

Figure 8:
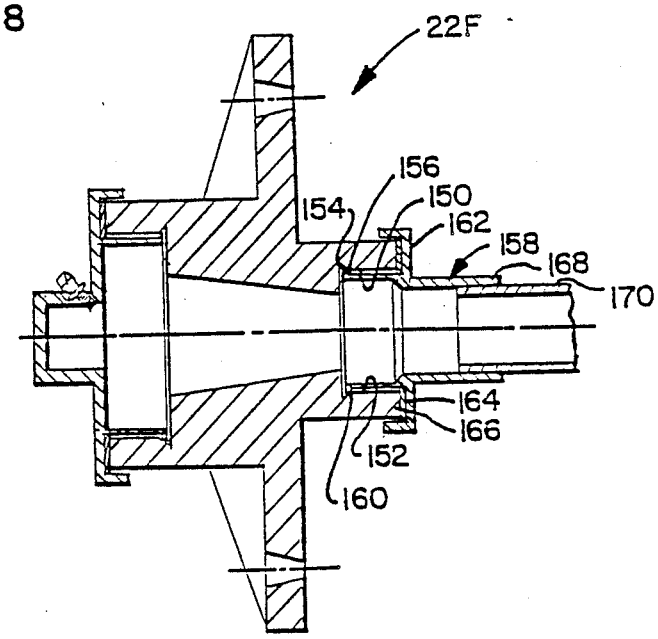

As shown in FIG. 8, the receiving cavity 150 of inlet section 152 of anchor body 22F includes a groove 154 in the wall of cavity 150. The first end 156 of connector 158 fits into cavity 150 and includes a ringular protrusion 160 for mating with groove 154 thereby providing a snap fit between connector 158 and anchor body 22. With this embodiment, a flange 162 preferably extends radially outwardly from the body of connector 158. In this way, if desired, adhesive 164 may be applied between flange 162 and end 166 of anchor body 22 to insure a seal and a solid attachment. The second end 168 of connector 158 is sealingly connected with conduit 170 in a fashion previously described.

Figure 9:
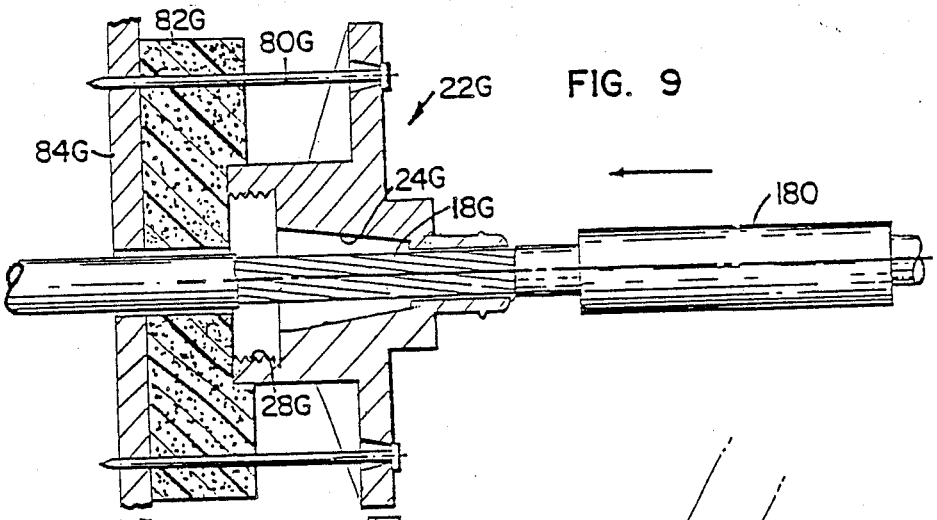
FIGS. 9–11 are partial cross-sectional views illustrating the use of a heat shrink tube to seal between the inlet section of an anchor device and a tendon covering.
Figure 10:
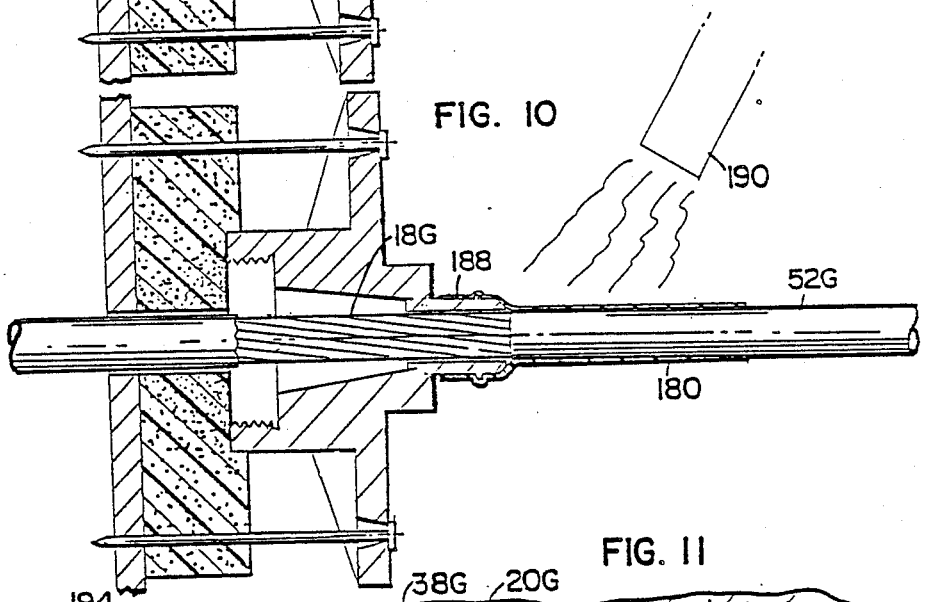
Figure 11:
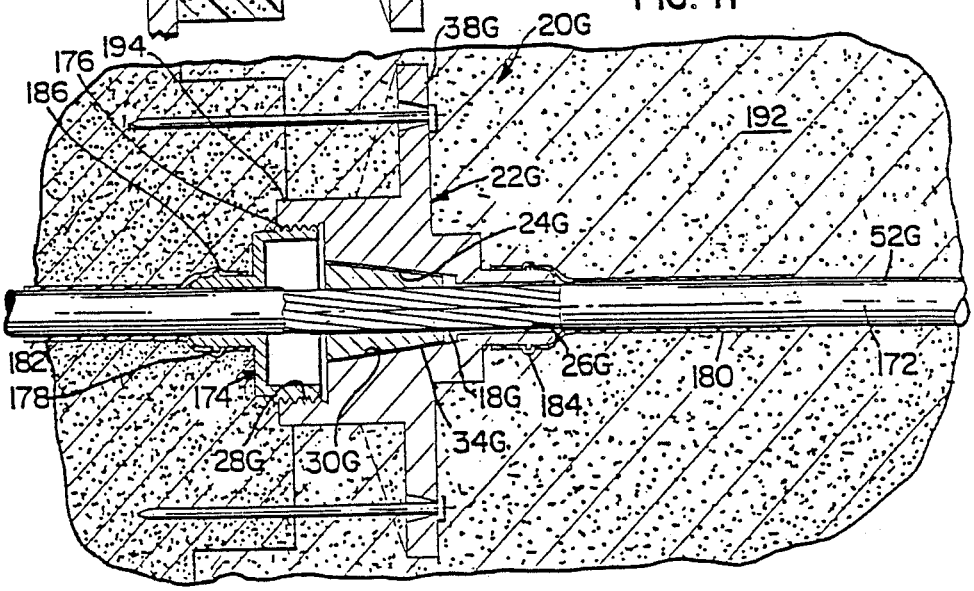

A further embodiment and method is shown in FIGS. 9–11. With reference to FIG. 11, anchor device 20G is similar to preferred embodiment anchor device 20 previously described except as indicated hereinafter. Furthermore, similar elements are designated by similar numerals except the elements of the present embodiment have numerals with a following "G" to distinguish the present embodiment from device 20.

Anchor device 20G includes anchor body 22G having a central passage 24G through which tendon 18G passes. Tendon 18G includes a corrosion resistant covering 52G except in a region around where anchor device 20G holds tendon 18G. Central passage 24G includes an inlet section 26G, an outlet section 28G, and a central section 30G therebetween. Central section 30G is formed to include a conical portion for receiving and providing a seat for wedges 34G. It is pointed out that two different wedges 34G are shown in cross section in FIG. 11. Inlet and outlet sections 26G and 28G have surrounding walls with outer first and second diameters, respectively. The first diameter is smaller than the second diameter so that the wall of inlet section 26G has a smaller transverse dimension than the wall of outlet section 28G. As indicated hereinbefore, it is necessary for outlet section 28G to be larger than the inlet section 26G so that wedges 34G may be inserted during the stressing of tendon 18G.

A reducer member 174 has first and second end portions 176 and 178. First end portion 176 threadingly mates with outlet section 28G of anchor body 22G. Second end portion 178 has a wall with an outer third diameter substantially similar to the first diameter of anchor body 22G.

First and second heat shrink tubes 180 and 182 provide the sealing mechanism for anchor device 20G. First heat shrink tube 180 seals between the wall of inlet section 26G and covering 52G on tendon 18G. Similarly, second heat shrink tube 182 seals between the second end portion 178 of reducer 174 and covering 52G. In this regard, tubes 180 and 182 contract the mast to fit snguly on covering 52G of tendon 18G while the wall of inlet section 26G and second end portion 178 of reducer member 174 hold the larger formation of the heat shrink tubes. Both the wall of inlet section 26G and the wall of second end portion 178 of reducer member 174 include encircling ringular protrusions 184 and 186 to better retain tubes 180 and 182 thereto. In this way, the incomplete covering region of tendon 18G around where wedges 34G of anchor device 20G hold tendon 18G is covered not only by anchor body 22G and reducer 174, but also by the first and second heat shrink tubes 180 and 182. and, in this way, the integrity of the corrosion resistant covering mechanism for tendon 18G is maintained.

To use, as shown in FIG. 9, tendon 18G is passed through first heat shrink tube 180 and the central passage 24G of anchor body 22G. Either before or after passing the tendon therethrough, anchor body 22G is fixed at a predetermined location. As discussed with respect to preferred embodiment 20, anchor body 22G is fastened with nails 80G to a form 84G with a block 82G to space the items apart. Block 82G also prevents concrete from entering outlet section 28G during the concrete casting step. Tendon 18G also passes through openings in block 82G and formboard 84G as necessary.

In order to prepare the assembly for casting the concrete, first heat shrink tube 180 is moved so that an end 188 fits around the wall of inlet section 26G. Heat gun 190 then directs heat against heat shrink tube 180 as illustrated in FIG. 9. In accordance with the common characteristic of heat shrink tubing, heat shrink tube 180 shrinks to tightly conform to the outer surface of the wall of inlet section 26G and covering 52G of tendon 18G. In this way, heat shrink tube 180 forms a seal between anchor body 22G and covering 52G.

Concrete 192 is then cast with respect to anchor body 22G and tendon 18G on the first side of flange 38C which faces in the direction of inlet section 26G. Some concrete is also cast on the other side of flange 38G in the region between flange 38G and block 82G, but the important result is that the second end 194 of anchor body 22G is free from concrete so that tendon 18G may be readily stressed and wedges 34G properly installed. Wedges 34G are then placed in the conical portion of central section 30G and tendon 18G is pulled in a known manner with respect to a fixed end (not shown) of the tendon. After stressing tendon 18G, the wedges are forced tightly into the conical portion of central section 30G to hold tendon 18G in the stressed condition.

For an end anchor, a plug 62 as previously described could then be installed to seal outlet section 28G. For an intermediate anchor as shown, reducer 174 having tendon 18G passing through its central passage, is fastened to the second end of anchor body 22G. A second heat shrink tube 182 with tendon 18G passing therethrough is then moved so that one end encircles second end portion 178. Heat is then directed against second heat shrink tube 182 to cause it to shrink and seal second end portion 178 with respect to the covering 52G of tendon 18G.

It is noted that the region wherein covering 52G has been removed may be fairly long in order to provide for convenient grasping and pulling of tendon 18G. The length of the uncovered region determines how long the heat shrink tubes must be.

In this way, the present apparatus provides complete corrosion protection for a tendon in a prestressed concrete slab. The advantages discussed and the details of structure and function set forth, however, must be considered exemplary. Consequently, it is noted in summary that changes made with respect to the preferred embodiment, especially in matters of shape, size and arrangement, to the full extent extended by the general meaning of the terms in which the appended claims are expressed, are within the principle of the invention.

What is claimed is:

1. A device for holding a tendon in a stressed condition in a prestressed concrete slab, said tendon having a corrosion resistant covering, said covering being incomplete in a region around where said device holds said tendon, said device comprising:

wedges;

an anchor body having a central passage for receiving said tendon, said passage having a longitudinal centerline, said passage having an inlet section, an outlet section and a central section therebetween, said central section including a conical portion for receiving and providing a seat for said wedges, said inlet section having a smaller transverse dimension through the longitudinal centerline than said outlet section, said body further including means for resisting longitudinal movement with respect to said slab;

a first conduit having first and second end portions;

means for sealingly attaching said first end portion of said first conduit to said inlet section of said anchor body, said attaching means including said inlet section having a first threaded portion and said first end portion of said first conduit being threaded to mate with said first threaded portion;

first means for sealing said second end portion of said first conduit to said covering on said tendon to enclose one end of said region where said corrosion resistant covering is incomplete; and means for sealingly closing said outlet section of said anchor body with respect to the other end of said region of said tendon where said corrosion resistant covering is incomplete, said closing means including said outlet section having a second threaded portion, said closing means also including a second conduit like said first conduit and second sealing means like said first sealing means, said closing means further including a reducer having a first threaded end mating with said second threaded portion of the outlet section of said anchor body and a second threaded end for mating with a first threaded end portion of said second conduit, said reducer having a central passage for receiving said tendon therethrough, said covering of said tendon, said reducer, said second conduit and said second sealing means enclosing said other end of said region of said tendon where said corrosion resisting covering is incomplete thereby protecting said entire region from outside corrosive fluids.

2. An apparatus for holding a tendon in a stressed condition in a prestressed concrete slab, said tendon having a corrosion resistant covering, said covering being incomplete in regions around where attachments of said apparatus are made to said tendon, said apparatus comprising:

a plurality of anchor bodies, a pair of said anchor bodies being attached at opposite ends of said tendon to said tendon, at least one other of said anchor bodies being attached to said tendon intermediate said pair of anchor bodies attached at opposite ends, each of said anchor bodies having a central passage for receiving such tendon, said passage habing a longitudinal centerline, said passage having an inlet section, an outlet section and a central section therebetween, said central section including a conical portion, said inlet section having a smaller transverse dimension through the longitudinal centerline than said outlet section, each of said anchor bodies further including means for resistiing longitudinal movement with respect to said slab;

a plurality of sets of wedges, one set of wedges fitting into each anchor body to seat in said conical portion to hold said tendon with respect to said anchor body;

a pair of plug members;

first means for sealingly attaching a different one of said plug members to each of said outlet sections of said anchor bodies at the opposite ends of said tendon;

a reducer having a central passage for receiving said tendon and opposite first and second ends;

second means for sealingly attaching the first end of said reducer to the outlet section of said at least one intermediate anchor body;

a plurality of conduits having first and second end portions, said first end portion of each of said conduits sealingly connecting with one of said inlet sections of said anchor bodies and said second end of said reducer; and means for sealing said second end portions of said conduits to said covering on said tendon to enclose said regions where said corrosion resistant covering is incomplete;

whereby said tendon is anchored at ends and at a location intermediate said ends and the regions of attachment are enclosed to minimize the possibility of corrosive fluids contacting said tendon at uncovered points.

* * * * *